US006595303B2

(12) United States Patent
Noe et al.

(10) Patent No.: US 6,595,303 B2
(45) Date of Patent: Jul. 22, 2003

(54) ROTARY STEERABLE DRILLING TOOL

(75) Inventors: Paul Noe, Sugarland, TX (US); David P. Kutinsky, Edmonton (CA)

(73) Assignee: Canadian Downhole Drill Systems, Niksu (CA)

( * ) Notice: Subject to any disclaimer, the term of this patent is extended or adjusted under 35 U.S.C. 154(b) by 0 days.

(21) Appl. No.: 09/907,480

(22) Filed: Jul. 17, 2001

(65) Prior Publication Data

US 2002/0053470 A1 May 9, 2002

Related U.S. Application Data

(60) Provisional application No. 60/245,188, filed on Nov. 3, 2000.

(30) Foreign Application Priority Data

Apr. 27, 2001 (CA) ..... 2345560

(51) Int. Cl.[7] ..... E21B 7/08; E21B 44/00

(52) U.S. Cl. ..... 175/74; 175/26; 175/73; 175/76

(58) Field of Search ..... 175/26, 61, 62, 175/73, 74, 76, 325.5

(56) References Cited

U.S. PATENT DOCUMENTS

| | | | | |
|---|---|---|---|---|
| 2,891,769 A | | 6/1959 | Page, Sr. et al. | 255/1.6 |
| 3,298,449 A | | 1/1967 | Bachman et al. | 175/76 |
| 3,370,657 A | | 2/1968 | Antle | 175/74 |
| 3,627,356 A | | 12/1971 | Anderson | 258/118 |
| 5,181,576 A | * | 1/1993 | Askew et al. | 175/325.3 |
| 5,421,421 A | * | 6/1995 | Appleton | 175/76 |
| 5,941,323 A | | 8/1999 | Warren | 175/74 |
| 6,092,610 A | | 7/2000 | Kosmala et al. | 175/61 |
| 6,109,370 A | | 8/2000 | Gray | 175/61 |
| 6,109,371 A | | 8/2000 | Kinnan | 175/61 |
| 6,109,372 A | | 8/2000 | Dorel et al. | 175/61 |
| 6,116,354 A | | 9/2000 | Buytaert | 175/55 |
| 6,129,160 A | | 10/2000 | Williams et al. | 175/107 |
| 6,209,664 B1 | | 4/2001 | Amaudric du Chaffaut | 175/61 |
| 6,328,119 B1 | * | 12/2001 | Gillis et al. | 175/325.1 |
| 6,394,193 B1 | | 5/2002 | Askew | 175/61 |
| 6,427,783 B2 | | 8/2002 | Krueger et al. | 175/40 |

FOREIGN PATENT DOCUMENTS

| | | | |
|---|---|---|---|
| GB | 2 340 153 A | 2/2000 | E21B/7/06 |

* cited by examiner

*Primary Examiner*—Thomas B. Will
*Assistant Examiner*—Brian Halford
(74) *Attorney, Agent, or Firm*—Ronald M. Anderson

(57) ABSTRACT

The device provides a method for positioning the drill bit in a drilling operation to achieve small changes in hole angle or azimuth as drilling proceeds. Two different positions are available to the operator. The first is a straight ahead position where the tool essentially becomes a packed hole stabilizer assembly. The second position tilts the bit across a rotating fulcrum to give a calculated offset at the bit-formation interface. The direction that the bit offset is applied in relation to current hole direction is controlled by positioning the orienting pistons prior to each drilling cycle, through the use of current measurement-while-drilling (MWD) technology. Components of the tool comprise a MWD housing, upper steering and drive mandrel, non-rotating position housing, lower drive mandrel splined with the upper mandrel, rotating fulcrum stabilizer and drill bit.

14 Claims, 21 Drawing Sheets

ROTARY STEERABLE DRILLING TOOL

RELATED APPLICATIONS

This application claims the benefit of the filing date of U.S. Provisional Application No. 60/245,188, filed Nov. 3, 2000, and Canadian Patent Application No. 2,345,560, filed Apr. 27, 2001, under the provisions of 35 U.S.C. § 119.

FIELD OF THE INVENTION

The invention relates to rotary drilling, and more particularly, to steered directional drilling with a rotary drilling tool.

BACKGROUND OF THE INVENTION

In the earth drilling art, it is well known to use downhole motors to rotate drill bits on the end of a non-rotating drill string. With the increasingly common use of directional drilling, where the well is drilled in an arc to produce a deliberately deviated well, bent subs have been developed for guiding the downhole motors in a desired drilling direction. The bent subs are angled, and thus cannot be used in association with rotating drill strings.

This invention is directed towards a tool that permits steered directional drilling with a rotary drilling tool.

SUMMARY OF THE INVENTION

The device contemplated provides a method for positioning the drill bit in a drilling operation to achieve small changes in hole angle or azimuth as drilling proceeds. Two different positions are available to the operator. The first is a straight ahead position where the tool essentially becomes a packed hole stabilizer assembly. The second position tilts the bit across a rotating fulcrum to give a calculated offset at the bit-formation interface. The direction that the bit offset is applied in relation to current hole direction is controlled by positioning the orienting pistons prior to each drilling cycle, through the use of current measurement-while-drilling (MWD) technology.

In one aspect of the invention, components of the tool comprise a MWD housing, upper steering and drive mandrel, non-rotating position housing, lower drive mandrel splined with the upper mandrel, rotating fulcrum stabilizer and drill bit.

If, after surveying and orienting during a connection, it is desired to drill with the tool in the oriented position, the rig pumps are activated. The pressure differential created by the bit jets below the tool will cause pistons to open from the ID of the tool into the tool chamber. As the pistons open, they will contact wings that come out into the path of travel of the upper mandrel as it comes down a spline, and bottoms out on the lower drive mandrel. This occurs as the drill string is being lowered to bottom. The extra length provided by the open wings moves a sliding sleeve centered over, but not attached to the upper mandrel, to a new position that in turn forces the orienting pistons to extend out into the borehole annulus. This extrusion pushes the non-rotating sleeve (outer housing) to the opposite side of the hole. When this force is applied across the rotating stabilizer, the stabilizer becomes a fulcrum point, and forces the drill bit against the side of the hole that is lined up with the orienting pistons. The calculated offset at the bit then tends to force the hole in the oriented direction as drilling proceeds. After the drilling cycle is complete, the tool will be picked up off bottom, and as the upper mandrel moves upward on the spline in the lower mandrel, a spring pushes the sliding sleeve back into its normal position, the orienting pistons retract into the outer housing, and the centering pistons come back out into the borehole annulus, thus returning the tool to its normal stabilized position. This cycle may be repeated until the desired result is achieved.

Once the desired hole angle and azimuth are achieved, the following procedure may be implemented to drill straight ahead. After making a connection and surveying, slowly lower the drill string to bottom and set a small amount of weight on the bit. Then engage the rig pumps. This time, when the activation pistons from the ID attempt to open the wings, they will be behind the sliding sleeve assembly, and the sliding sleeve will remain in its normal or centered position throughout the following drilling cycle.

Skillful alternating of the two above drilling positions will yield a borehole of minimum tortuosity, when compared to conventional steerable methods.

These and other aspects of the invention are described in the detailed description of the invention and claimed in the claims that follow.

BRIEF DESCRIPTION OF THE DRAWING FIGURES

The foregoing aspects and many of the attendant advantages of this invention will become more readily appreciated as the same becomes better understood by reference to the following detailed description, when taken in conjunction with the accompanying drawings, wherein.

DESCRIPTION OF THE PREFERRED EMBODIMENT

Figure 1:
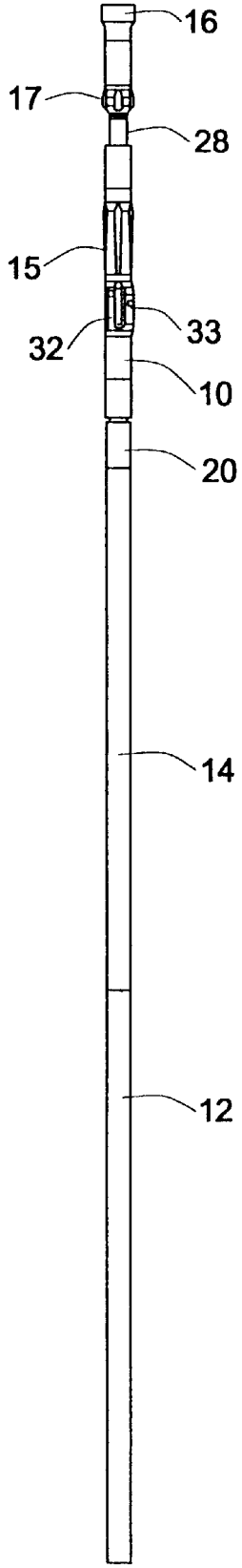
FIG. 1 is a side view of a drill string with rotary steerable tool according to the invention.

In this patent document, "comprising" is used in its inclusive sense and does not exclude other elements being present in the device. In addition, a reference to an element by the indefinite article "a" does not exclude the possibility that more than one of the elements is present. MWD means measurement-while-drilling. All seals and bearings described herein and shown in the drawings are conventional seals and bearings.

Figure 2B:
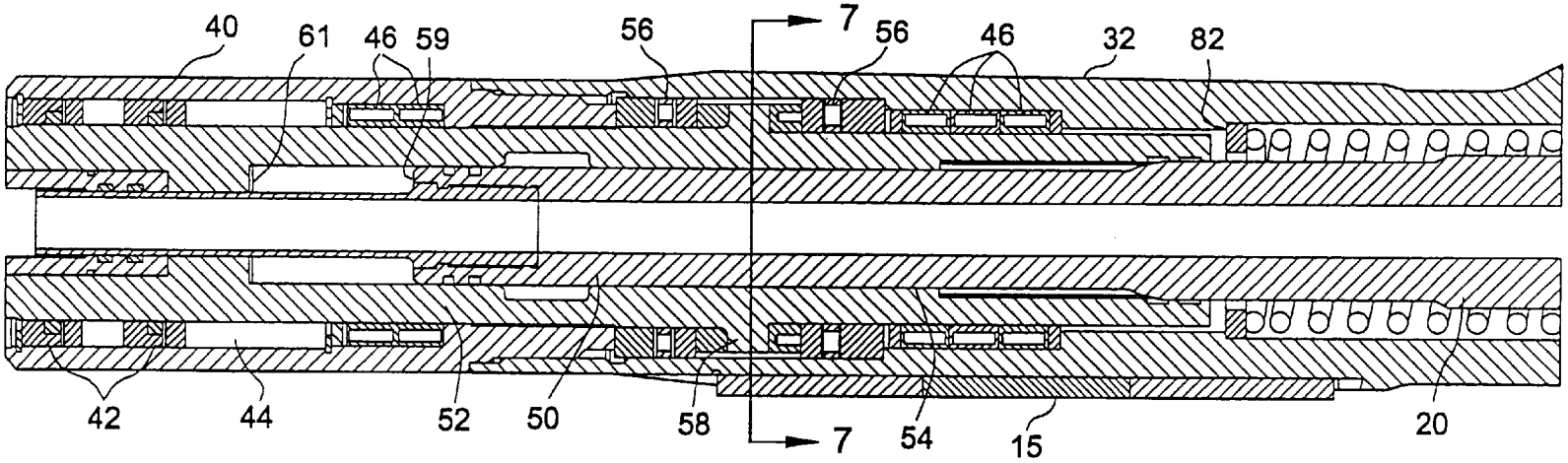
FIGS. 2A–2D are lengthwise connected sections (with some overlap) through a rotary steerable tool according to the invention showing the tool in pulled back position ready to extend the wings used to move the pistons into the offset drilling position.
Figure 2A:
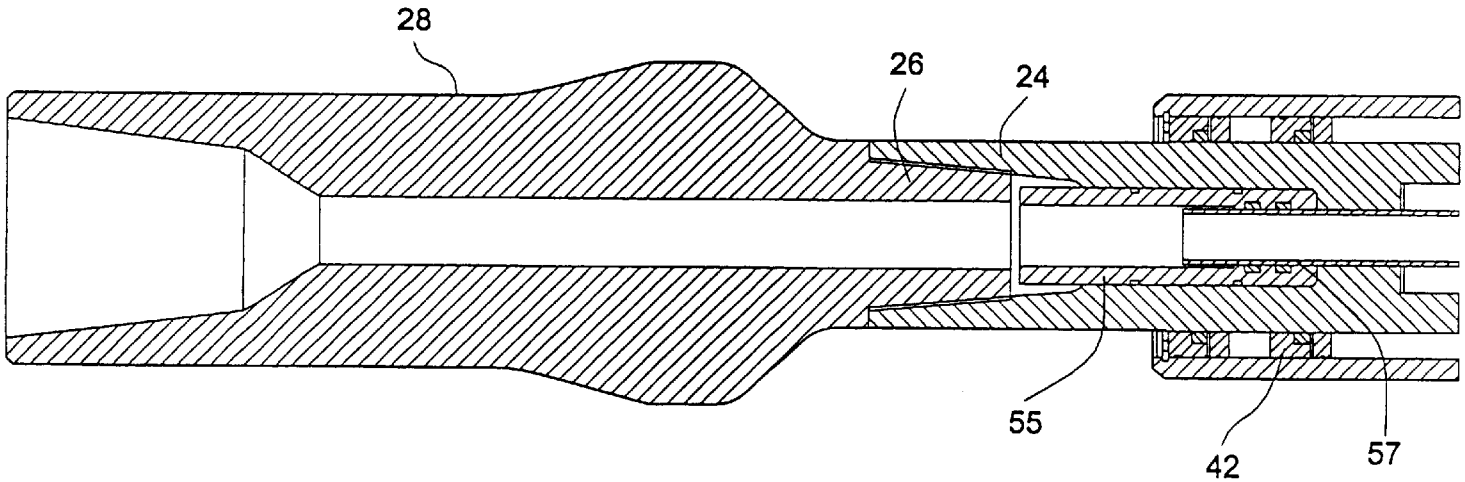
Figure 2D:
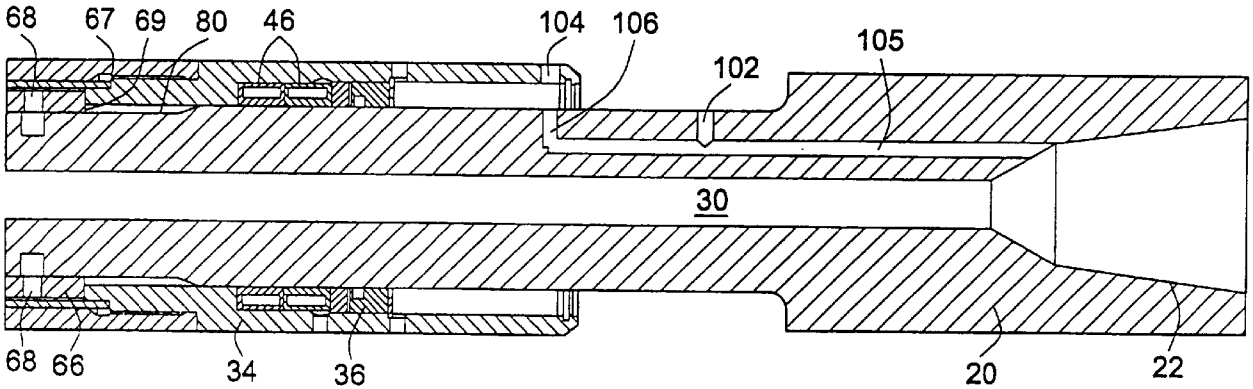
Figure 2C:
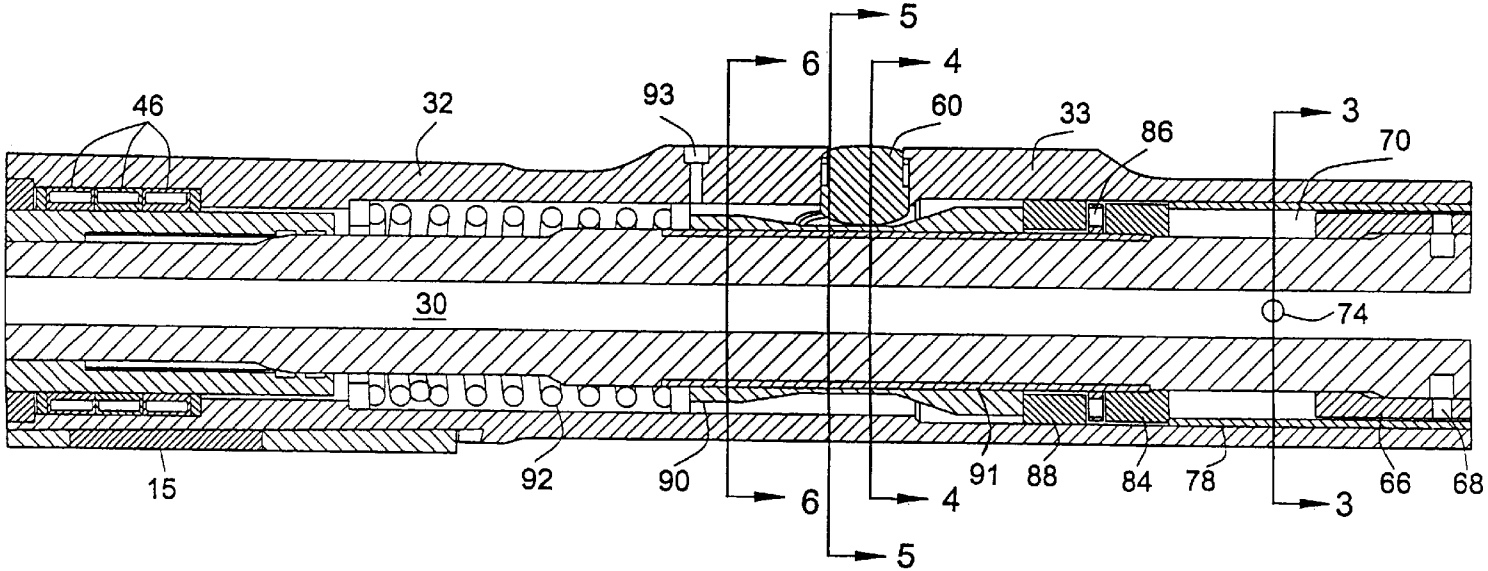
Figure 3:
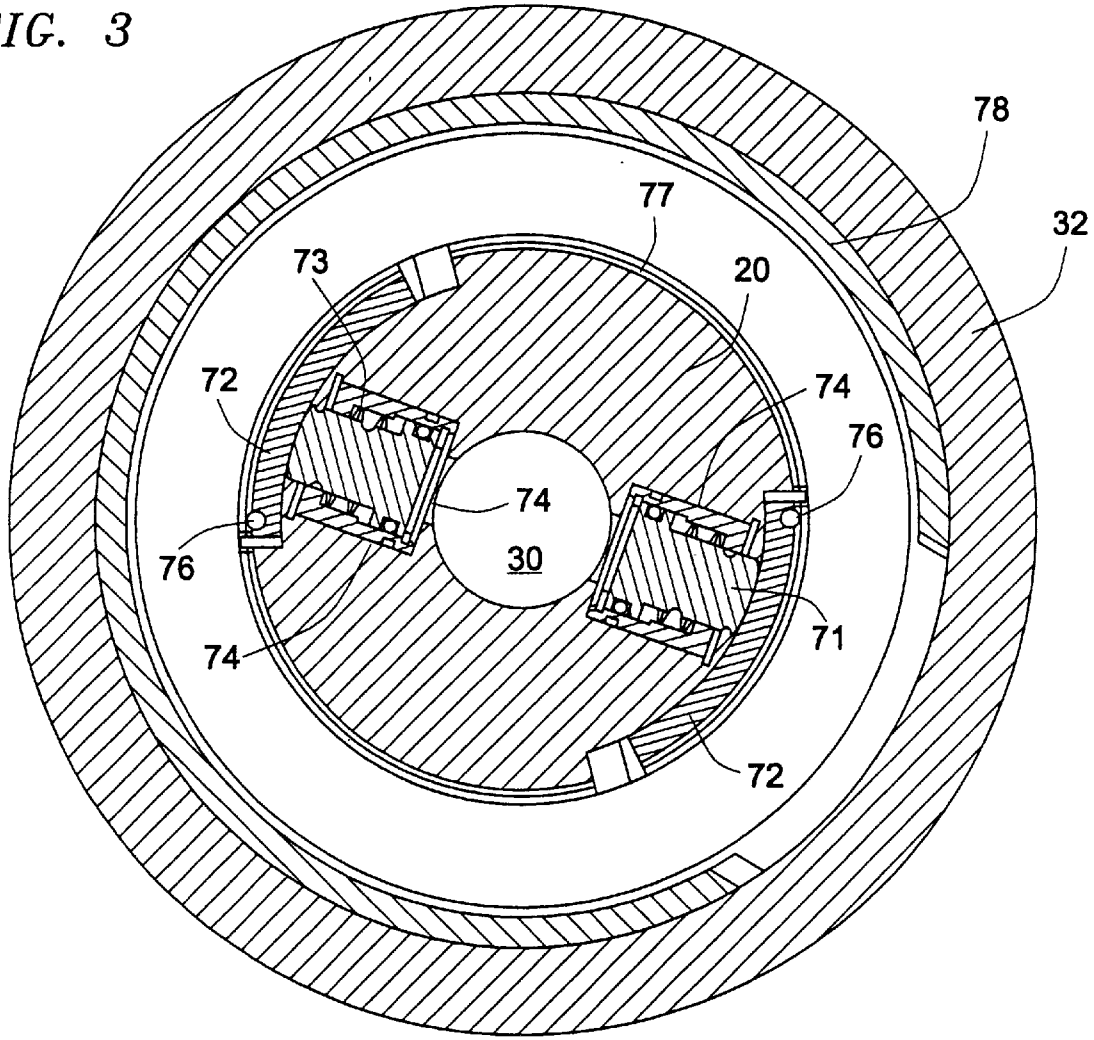
FIG. 3 is a cross section along section line 3—3 in FIG. 2C.
Figure 4:
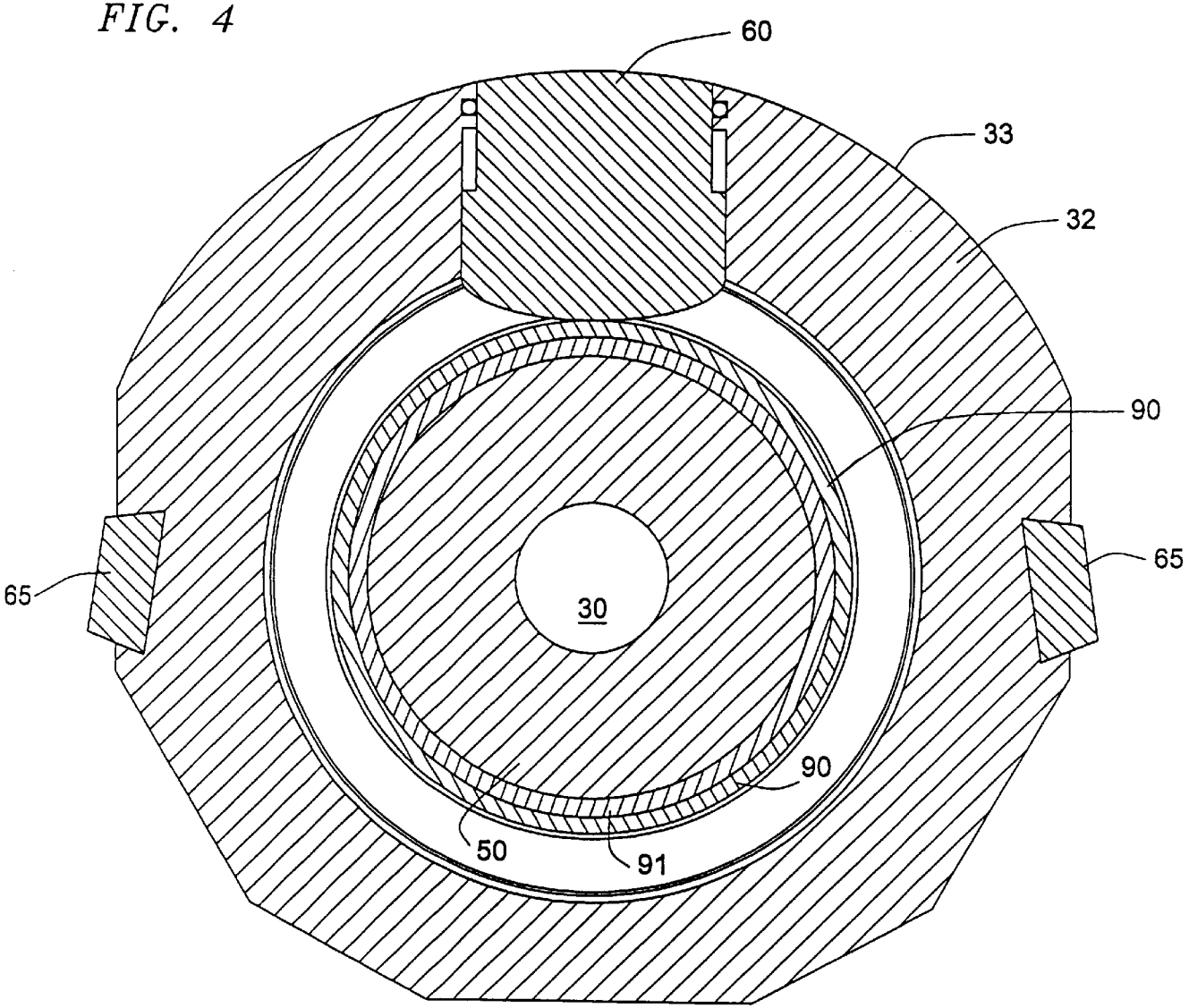
FIG. 4 is a cross section along section line 4—4 in FIGS. 2C and 8C.
Figure 5:
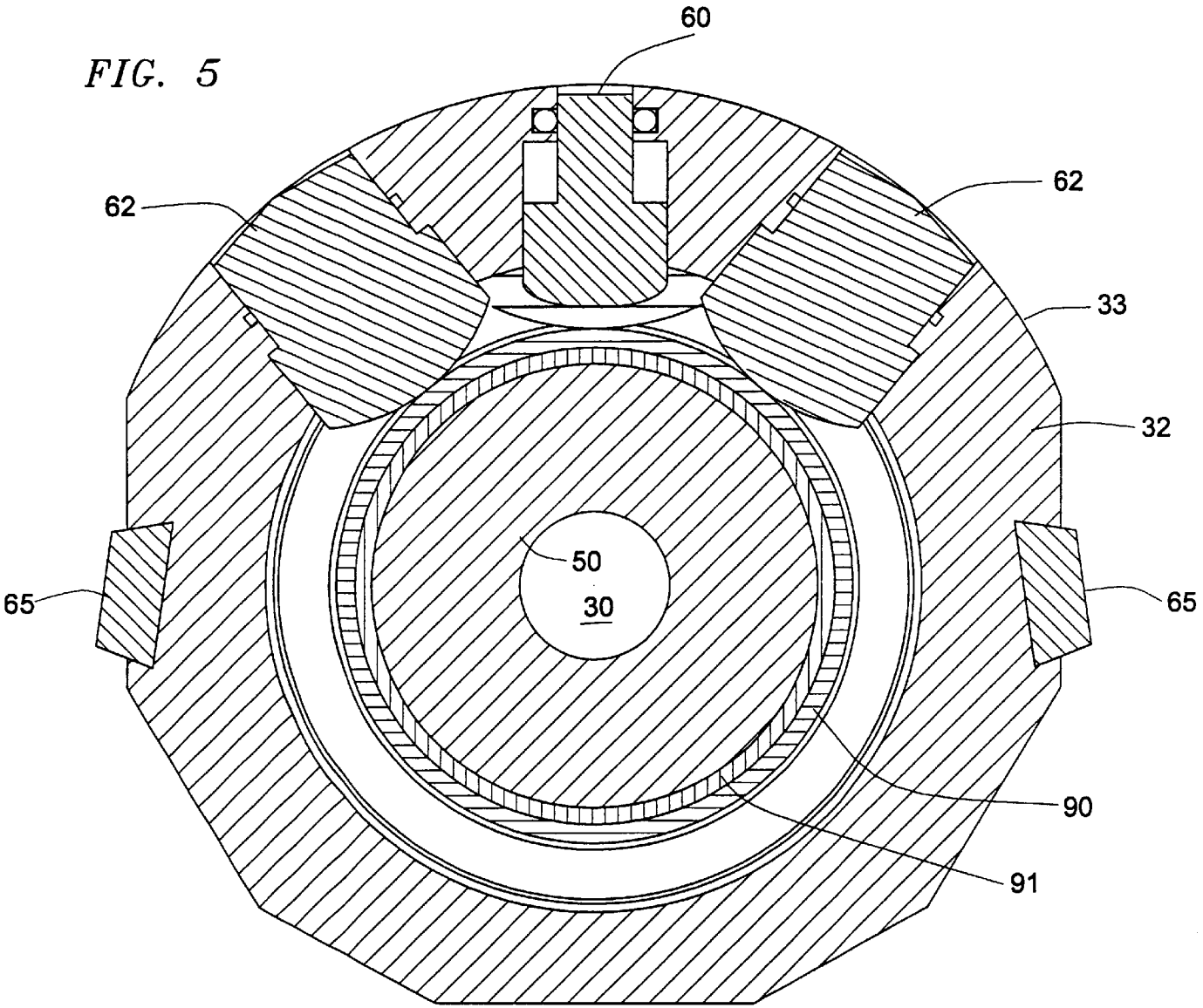
FIG. 5 is a cross section along section line 5—5 in FIGS. 2C and 8C.
Figure 6:
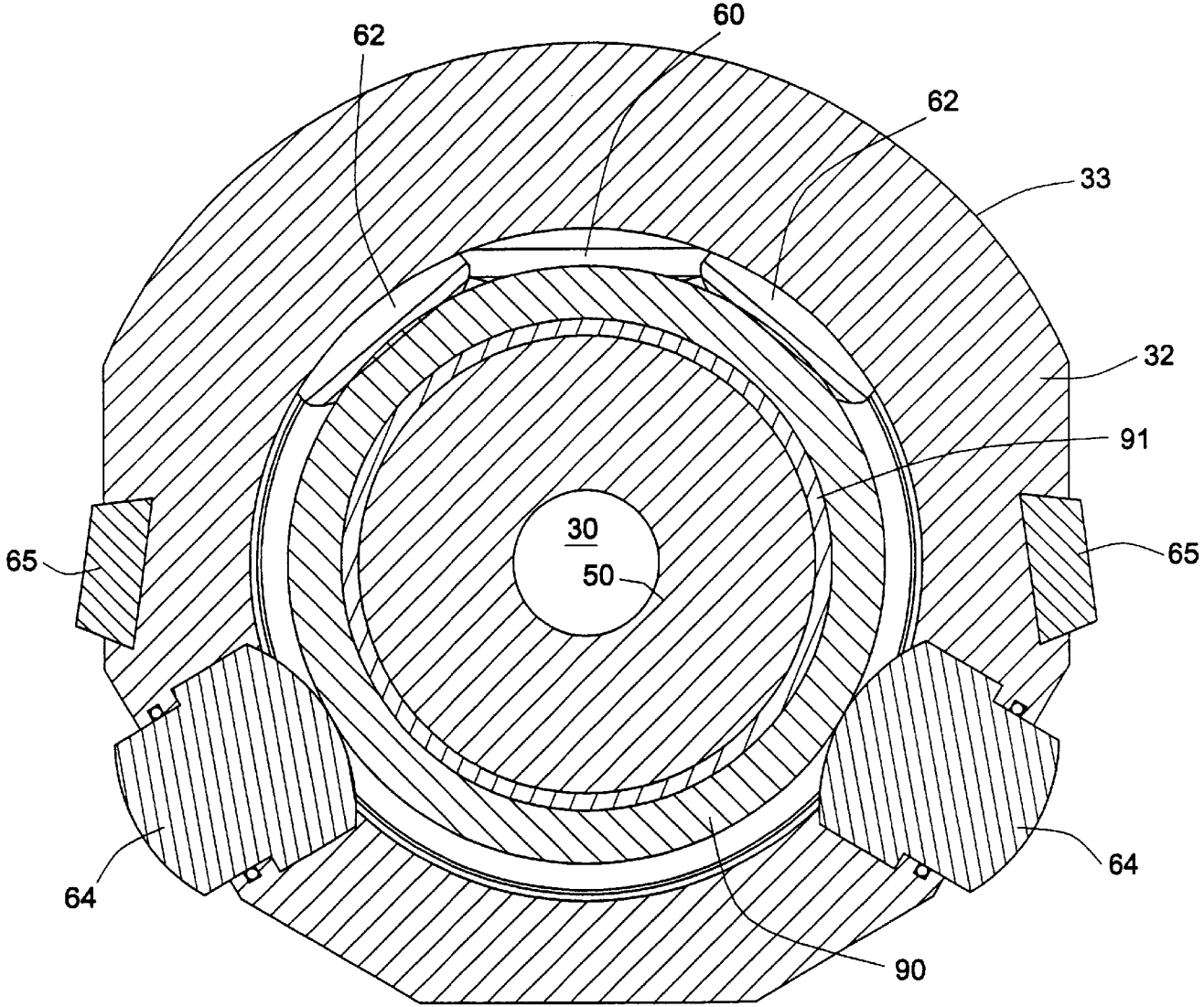
FIG. 6 is a cross section along section line 6—6 in FIGS. 2C and 8C.
Figure 7:
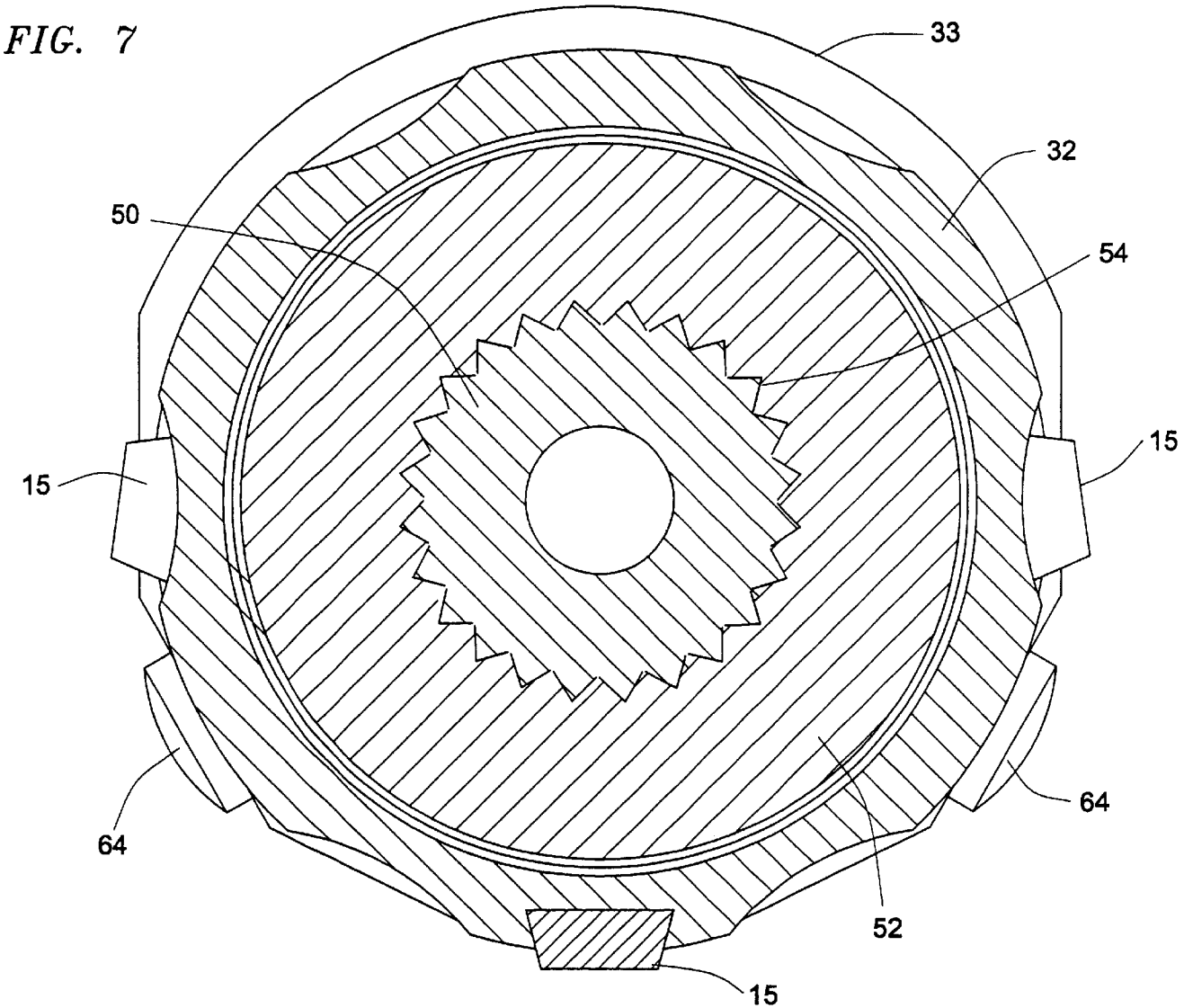
FIG. 7 is a cross section along section line 7—7 in FIGS. 2B and 8B.
Figure 8B:
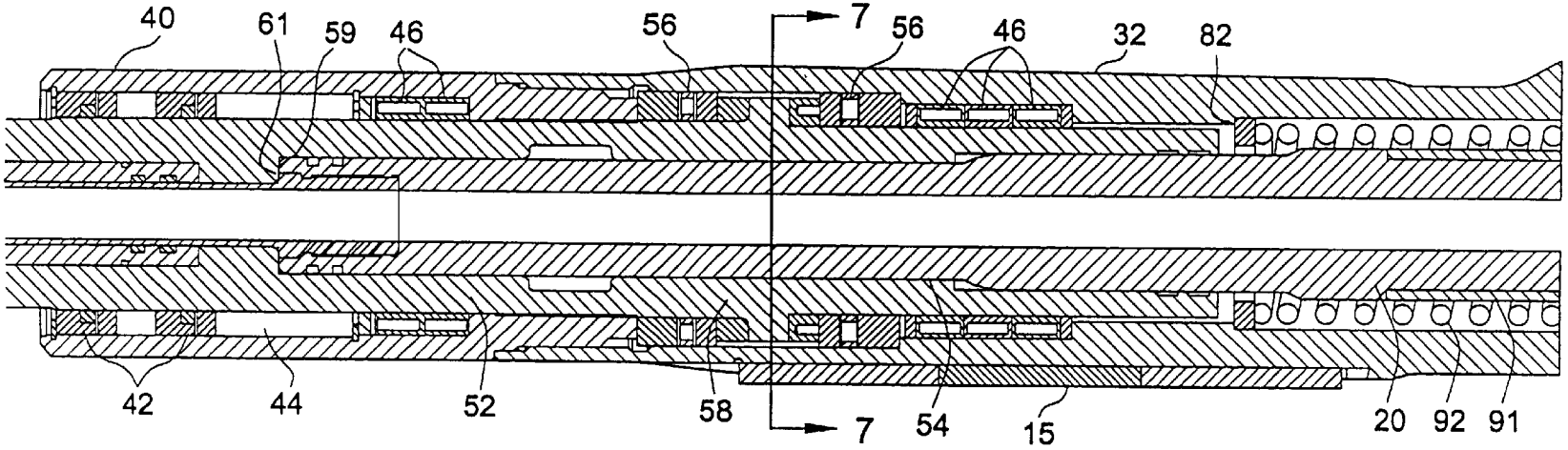
FIGS. 8A–8D are lengthwise connected sections (with some overlap) through a rotary steerable tool according to the invention showing the tool in straight ahead drilling position.
Figure 8A:
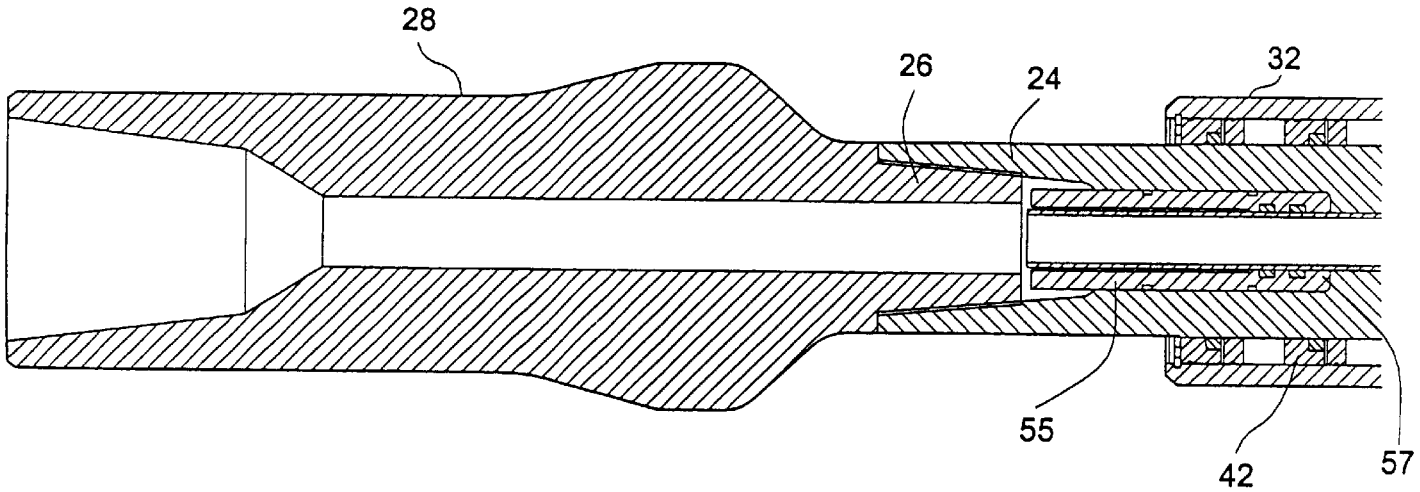
Figure 8D:
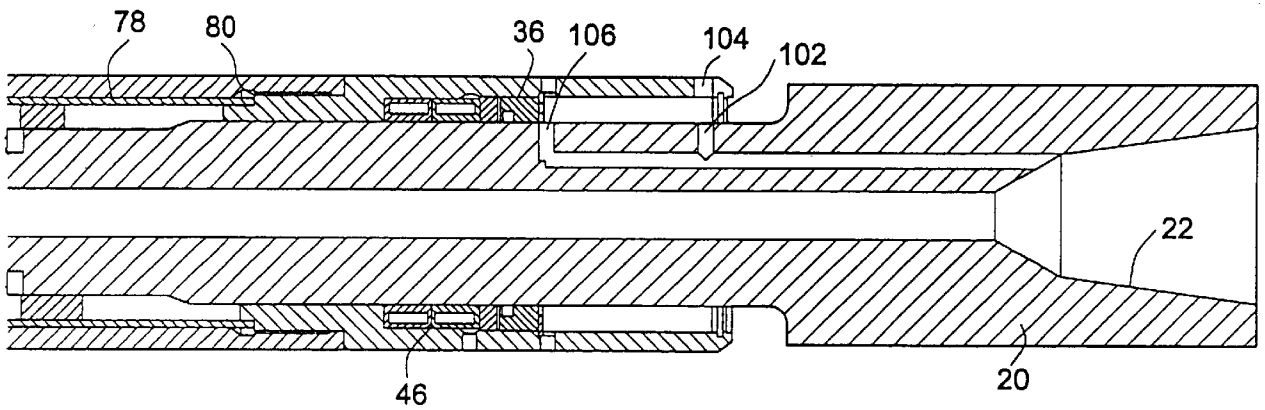
Figure 8C:
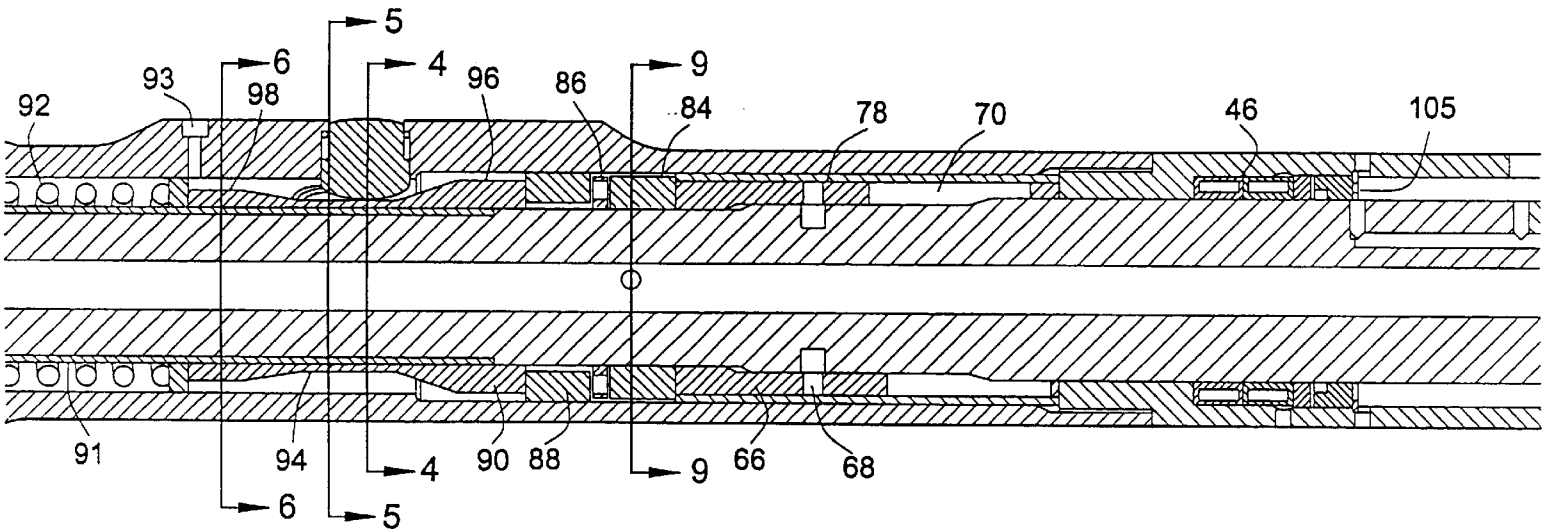

Referring to FIG. 1, which shows the overall assembly of a drill string according to the invention, a rotary steerable drilling tool 10 is shown located on a conventional drill string 12 between a conventional MWD tool 14 and a conventional drill bit 16. As shown more particularly in FIGS. 2A and 2D, rotary steerable drilling tool 10 includes a mandrel 20 having a conventional box connection 22 at an uphole end for connection into drill string 12 and a conventional box connection 24 at a downhole end for connection to a pin connection 26 of a drilling sub 28. Sub 28 is configured as a rotating stabilizer 17 provided on the drill string between rotary steerable drilling tool 10 and drill bit 16, and operates as a fulcrum for rotary steerable drilling tool 10 and drill bit 16 to pivot around. Drill bit 16 will conventionally have jets in the bit for egress of fluid from the drill string. At the surface, a conventional rig will include conventional pumps (not shown) for pumping fluid down drill string 12 to drill bit 16 and out the jets in the drill bit.

Figure 9:
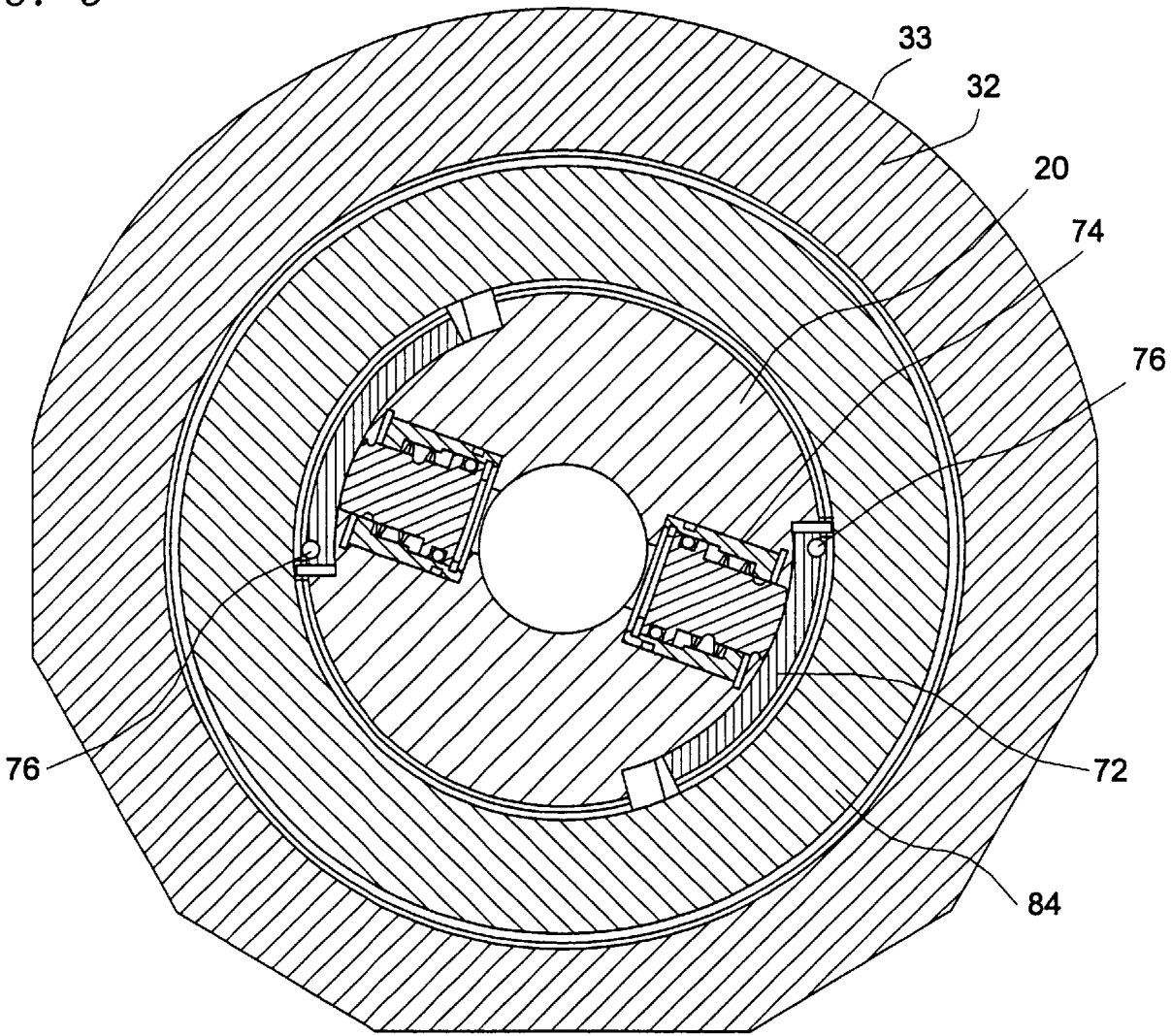
FIG. 9 is a cross section along section line 9—9 in FIG. 8C.
Figure 10:
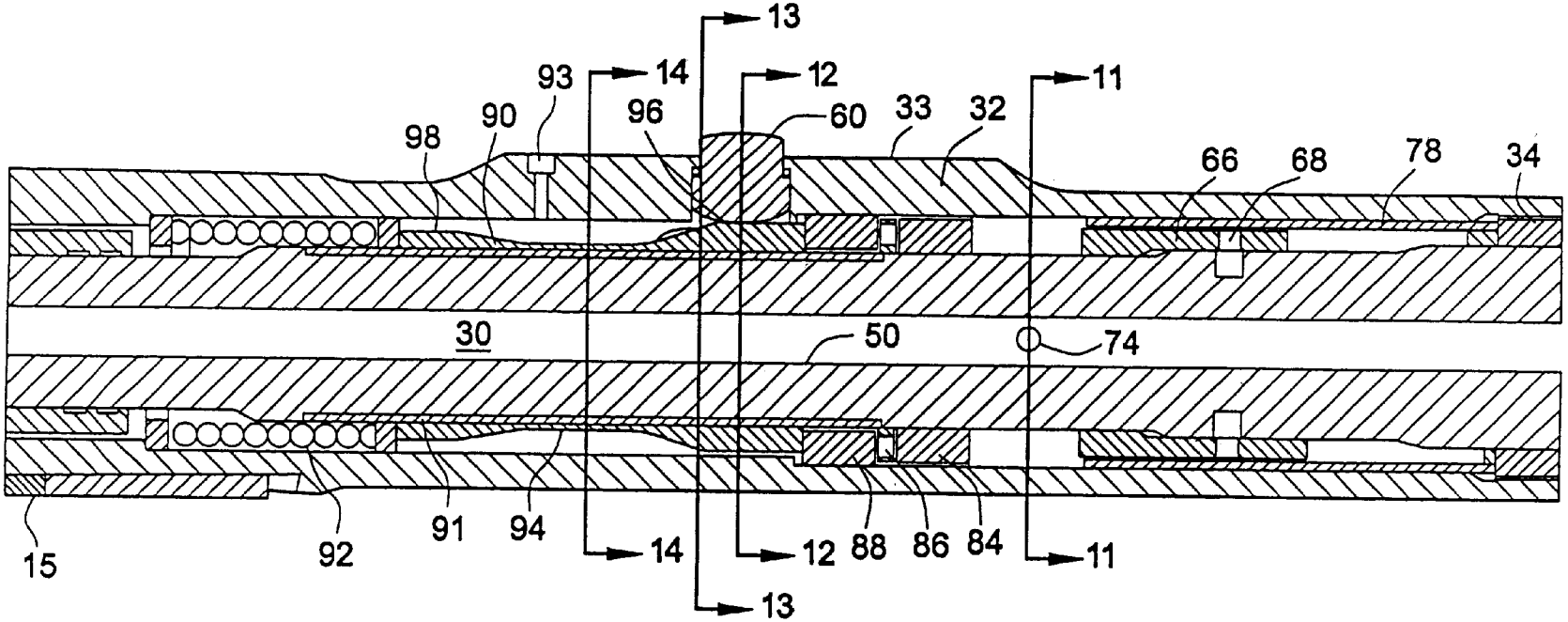
FIG. 10 is a lengthwise section through a rotary steerable tool according to the invention showing the tool in offset drilling position.
Figure 11:
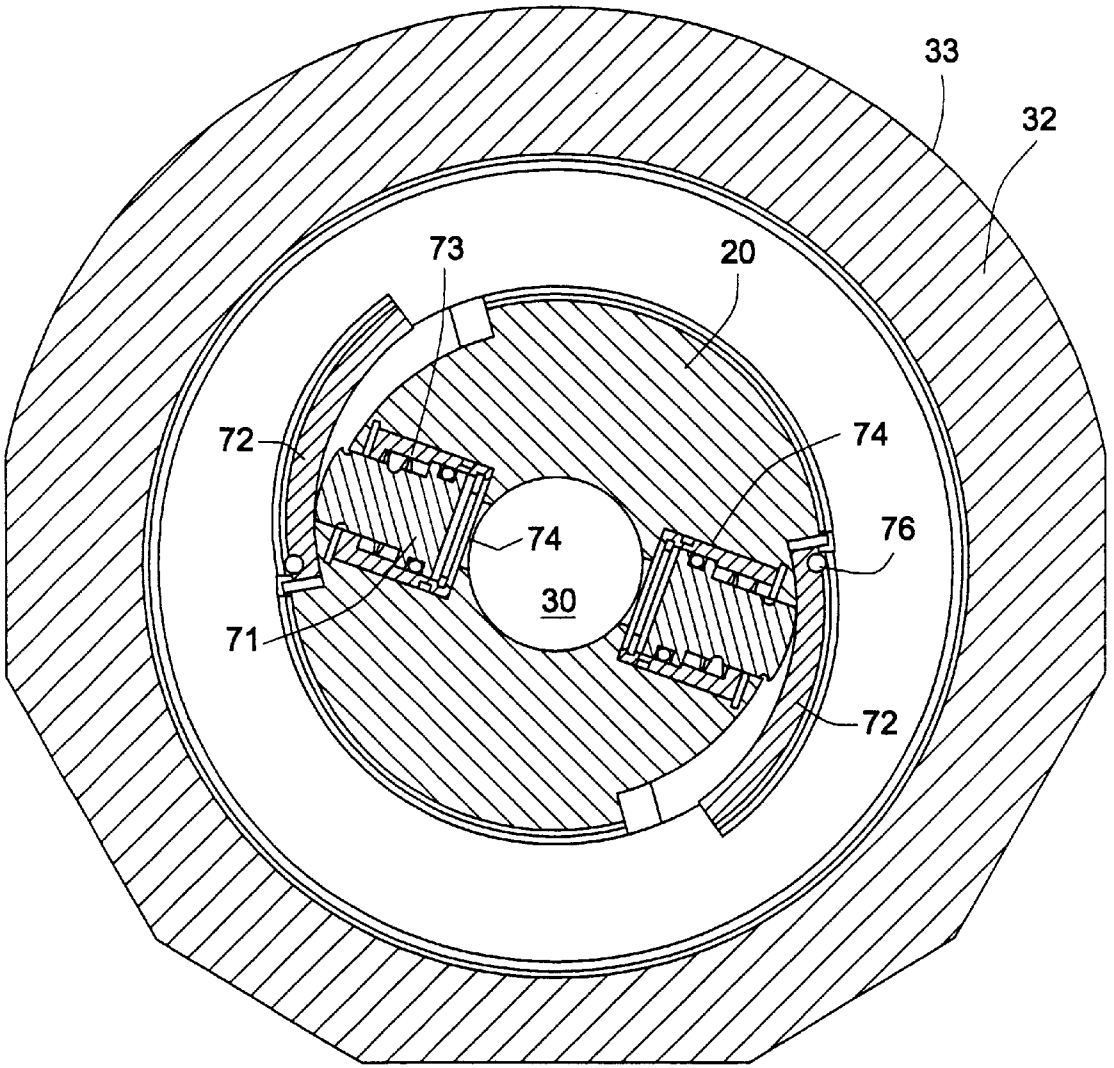
FIG. 11 is a cross section along section line 11—11 in FIG. 10.
Figure 12:
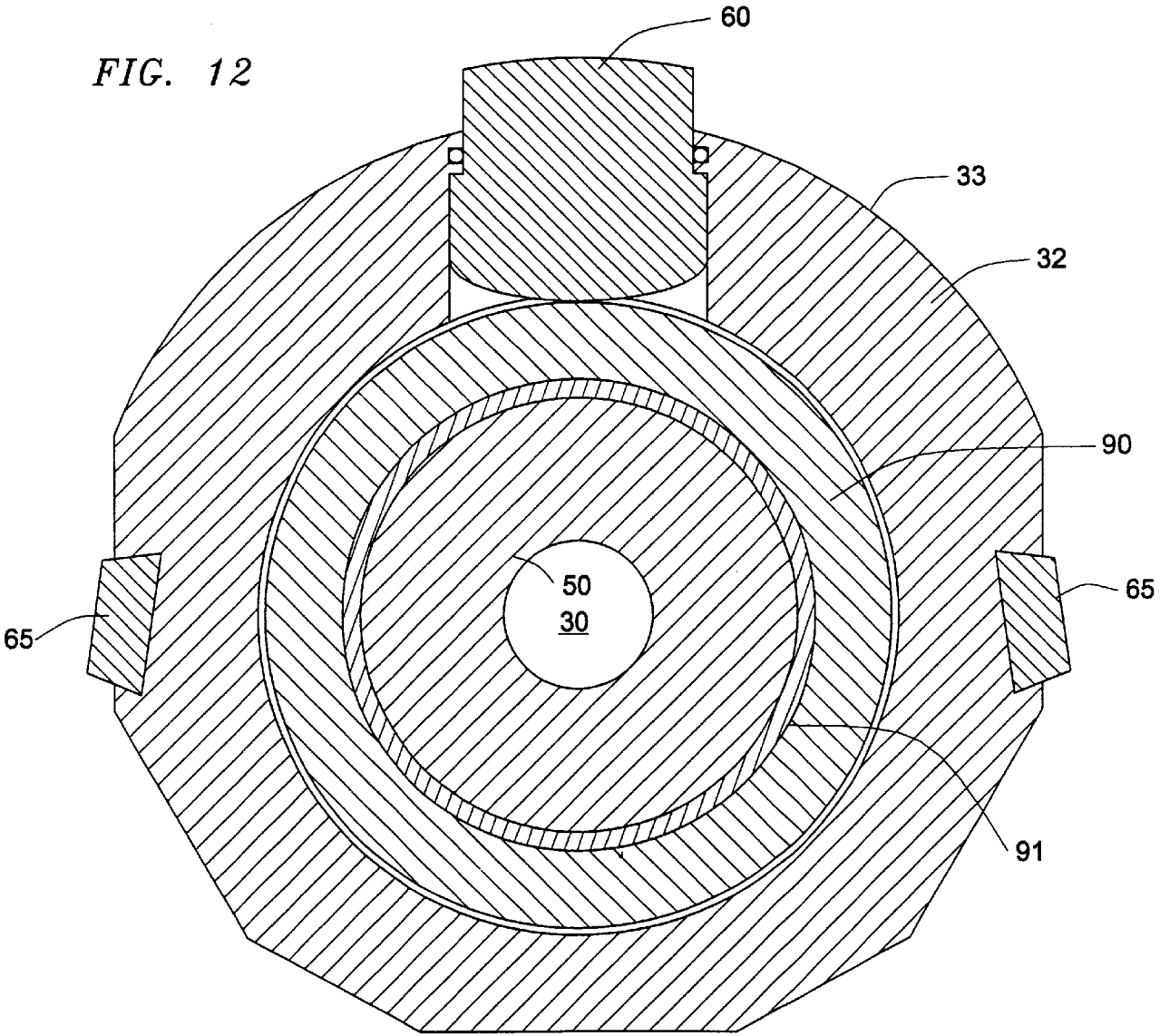
FIG. 12 is a cross section along section line 12—12 in FIG. 10.
Figure 13:
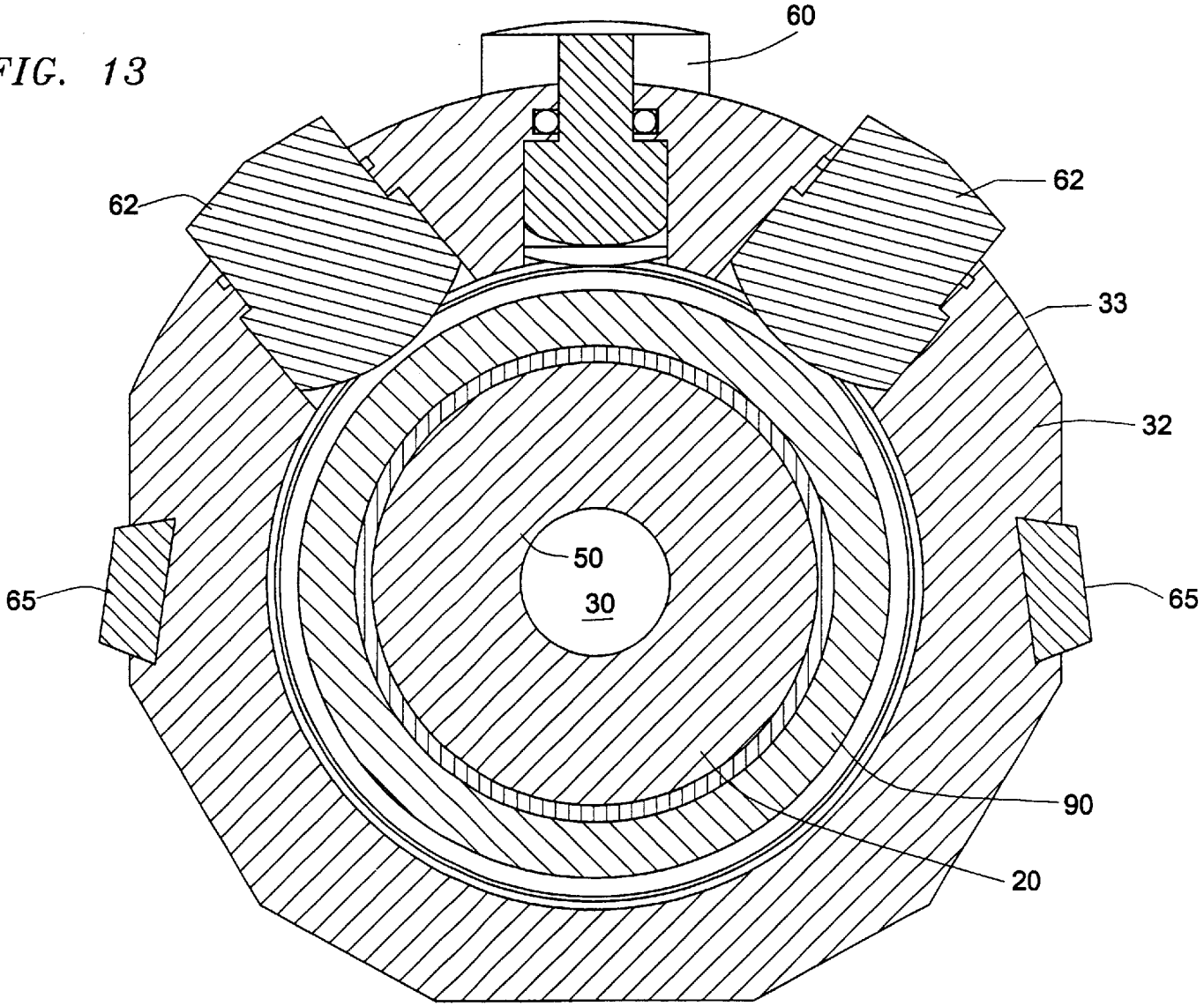
FIG. 13 is a cross section along section line 13—13 in FIG. 10.
Figure 14:
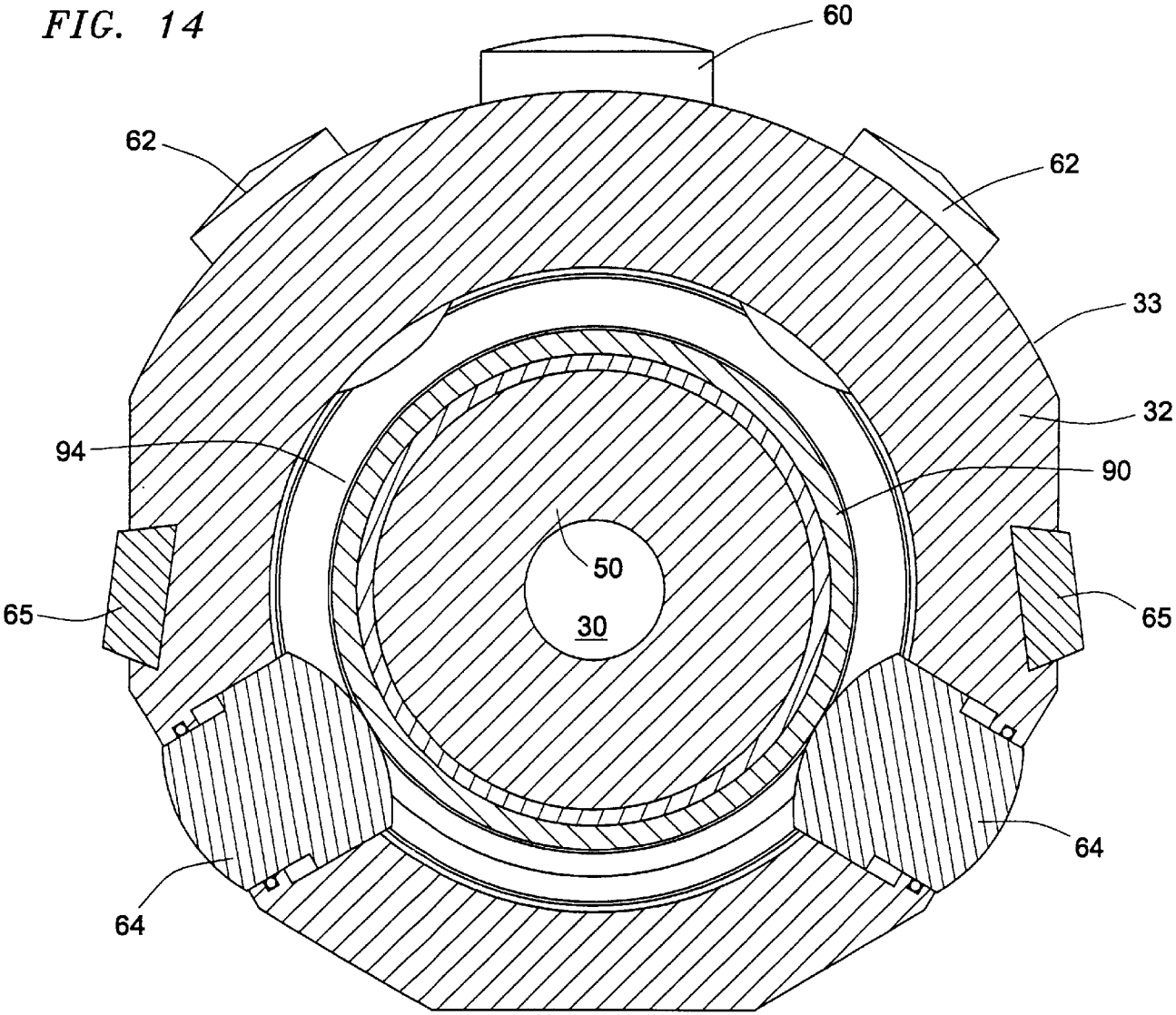
FIG. 14 is a cross section along section line 14—14 in FIG. 10.
Figure 15:
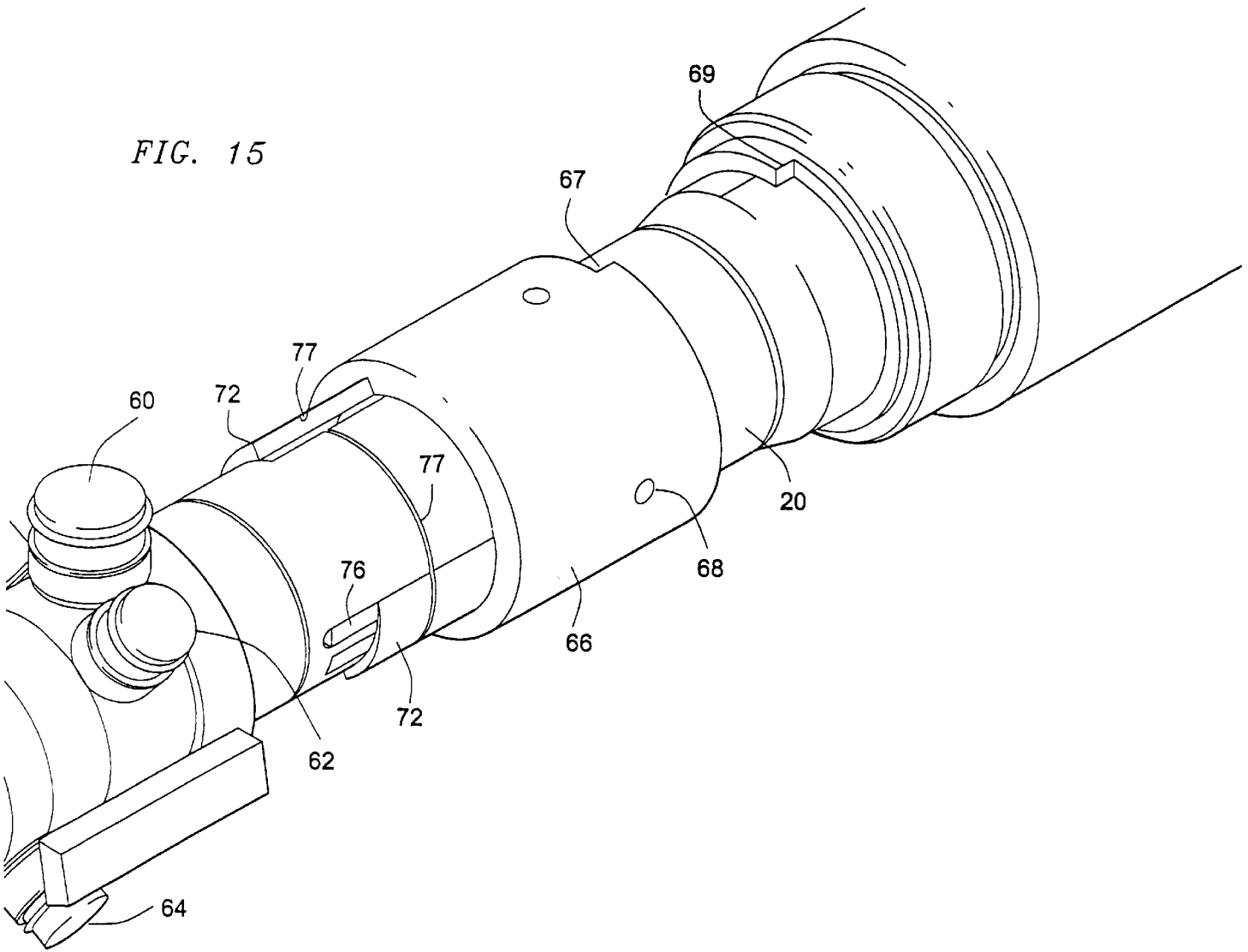
FIG. 15 is a perspective view of a rotary steerable tool according to the invention showing wings in the extended position with the housing partly broken away to show the mandrel.
Figure 16:
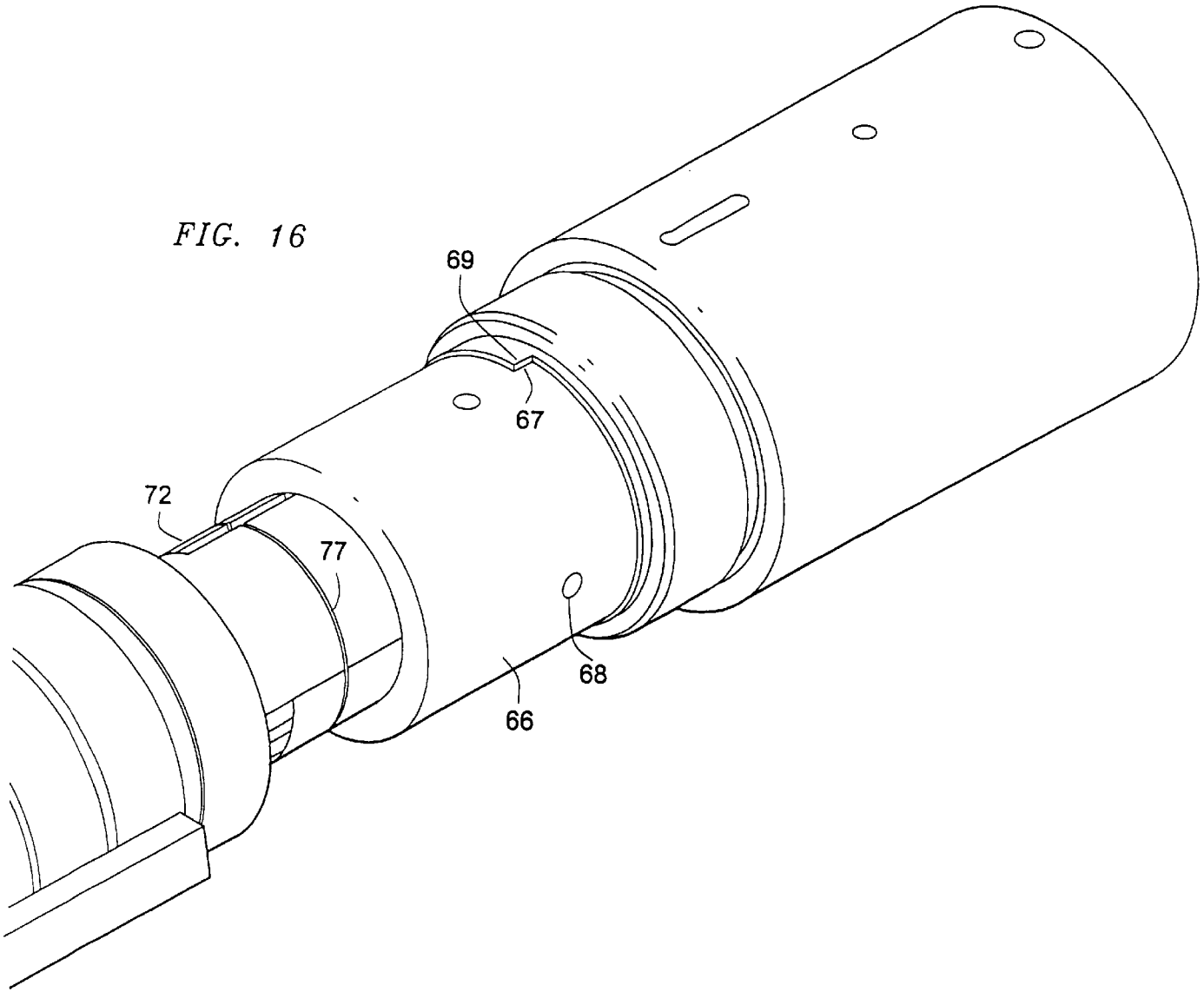
FIG. 16 is a perspective view of a rotary steerable tool according to the invention with the housing broken away to show wings in the retracted position.
Figure 17:
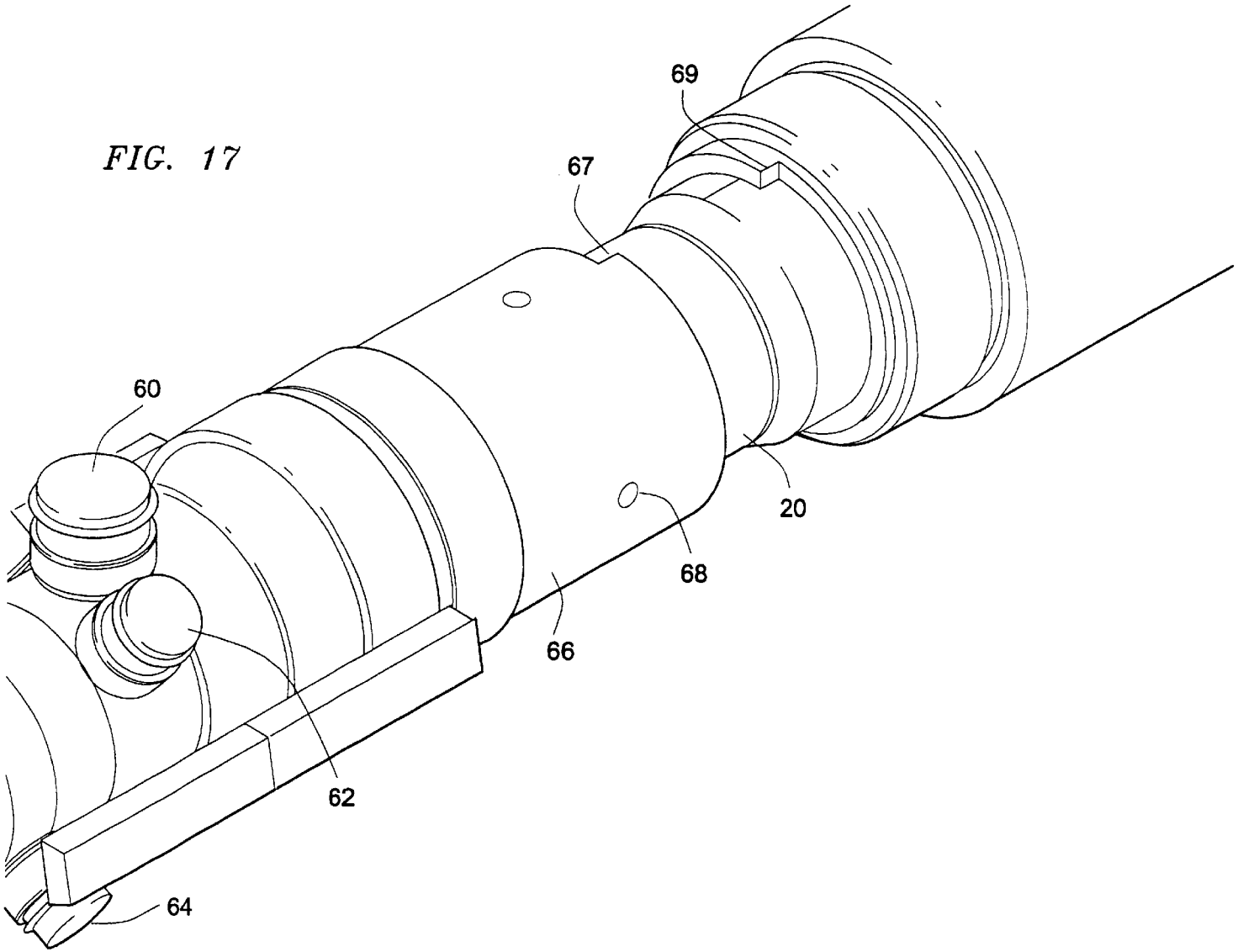
FIG. 17 is a close-up view of mating dog clutch faces for use in orienting the rotary steerable tool according to the invention.

The components of rotary steerable drilling tool 10 are best seen in FIGS. 2A–2D, which show the tool in the pulled back off-bottom position, ready to set the tool into either a straight ahead drilling position or an offset drilling position. FIGS. 3–7 are sections corresponding to the section lines on FIGS. 2A–2D. FIGS. 15–19 provide perspective views of the tool broken away to show the internal workings. FIGS. 3–7 are sections corresponding to the section lines on FIGS. 2A–2D. FIGS. 8A–8D show rotary steerable drilling tool 10 in a straight ahead on-bottom drilling position. FIG. 9 is a section corresponding to the section line 9—9 on FIG. 8C. The other sections shown on FIGS. 8A–8D correspond to FIGS. 4–7 as well, since the sections do not change in those positions. FIG. 10 shows rotary steerable drilling tool 10 in position for offset drilling, insofar as it is different from the position shown in FIGS. 8A–8D. FIGS. 11–14 are sections corresponding to the section lines on FIG. 10.

Referring to FIGS. 2A–2D, 3–7, 8A–8D, and 15–19, and particularly to FIGS. 2A–2D, a bore 30 is provided within mandrel 20 for communication of fluid from surface to drill bit 16. A housing 32 is mounted on mandrel 20 for rotation in relation to mandrel 20. During drilling, housing 32 is held against rotation by frictional engagement with the wellbore and the mandrel rotates, typically at about 120 rpm. Housing 32 is provided with an adjustable offset mechanism that can be adjusted from the surface so that rotary steerable drilling tool 10 can be operated in and changed between a straight ahead drilling position and an offset drilling position. In the straight ahead drilling position, asymmetry of housing 32, namely thickening 33 of housing 32 on one side, in combination with pistons on the other side of housing 32 yields a tool that is centered in the hole. In an offset drilling position, pistons on the thickened side of housing 32 drive tool 10 to one side of the wellbore, and thus provide a stationary fulcrum in which mandrel 20 rotates to force the drill bit in a chosen direction. Three hole grippers 15 are provided on the exterior surface of housing 32 downhole of thickened section 33. One of hole grippers 15 is on the opposite side of the thickened section, and the other two are at about 90 degrees to thickened section 33. Hole grippers 15 are oriented such that when rotary steerable tool 10 is offset in the hole by ½ degree by operation of the adjustable offset mechanism described below, hole grippers 15 will lie parallel to the hole wall, so that hole grippers 15 make maximum contact with the hole wall. Hole grippers 15 grip the wall of the hole and prevent housing 32 from rotating, as well as preventing premature wear of housing 32 against the wellbore.

Housing 32 has threaded on its uphole end an end cap 34 holding a piston 36, and on its downhole end another end cap 40 holding a floating piston seal 42 within chamber 44. Floating piston 42 accommodates pressure changes caused by movement of the housing on mandrel 20. Housing 32 rotates on mandrel 20 on seven bearings 46. Mandrel 20 is formed from an upper mandrel 50 and lower mandrel 52 connected by splines 54. A sleeve 55, is held in the bore of lower mandrel 52, and in the downhole end of upper mandrel 50, by a pin on sub 28. Appropriate seals are provided as shown to prevent fluid from the mandrel bore from entering between the upper mandrel 50 and lower mandrel 52 at 57. Downhole movement of upper mandrel 50 in lower mandrel 52 is limited by respective shoulders 59 and 61. Housing 32 is supported on lower mandrel 52 by thrust bearings 56 on either side of a shoulder 58 on lower mandrel 52.

Figure 18:
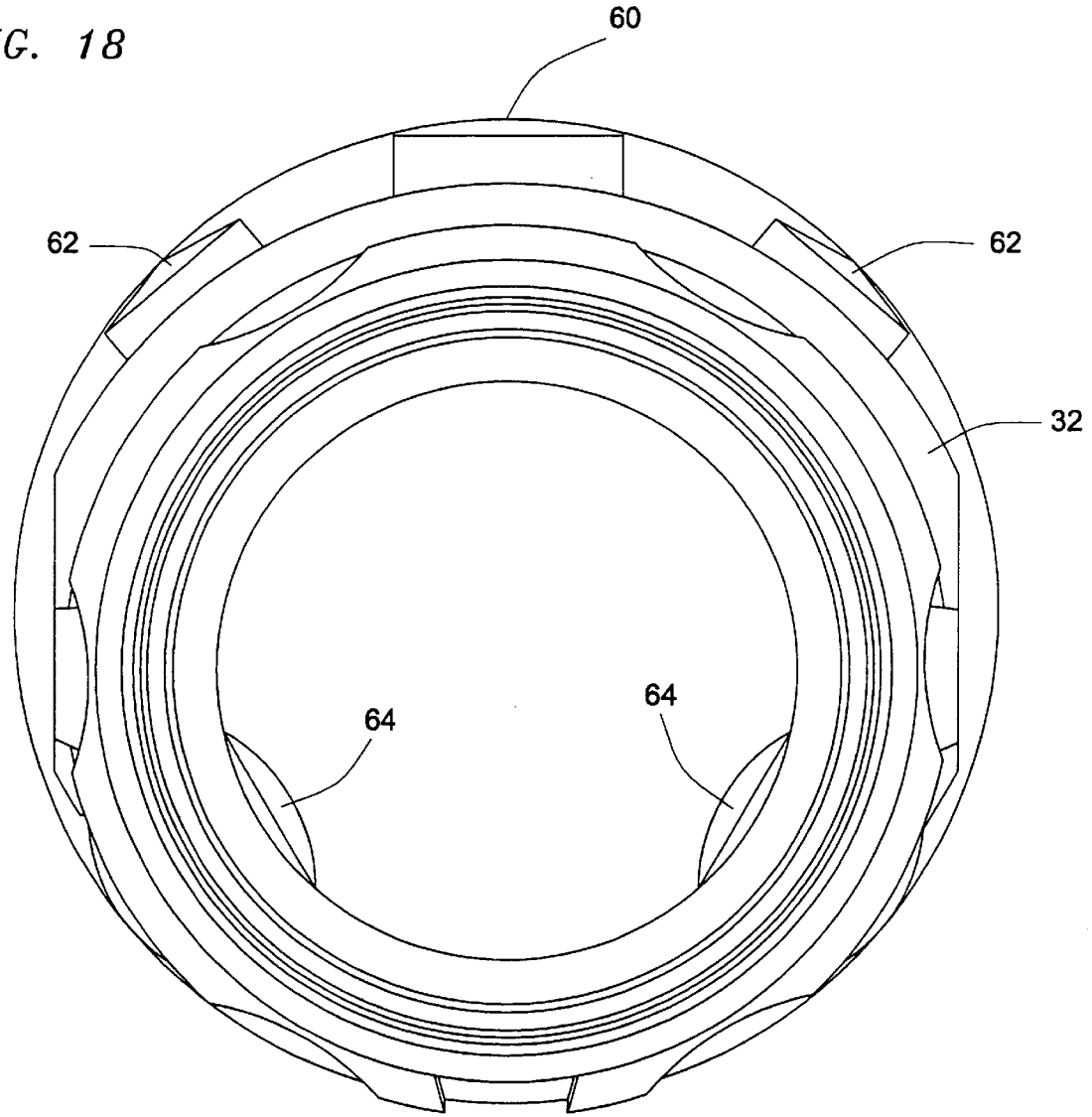
FIG. 18 is an end view of a rotary steerable tool according to the invention showing pistons set in the offset drilling position.
Figure 19:
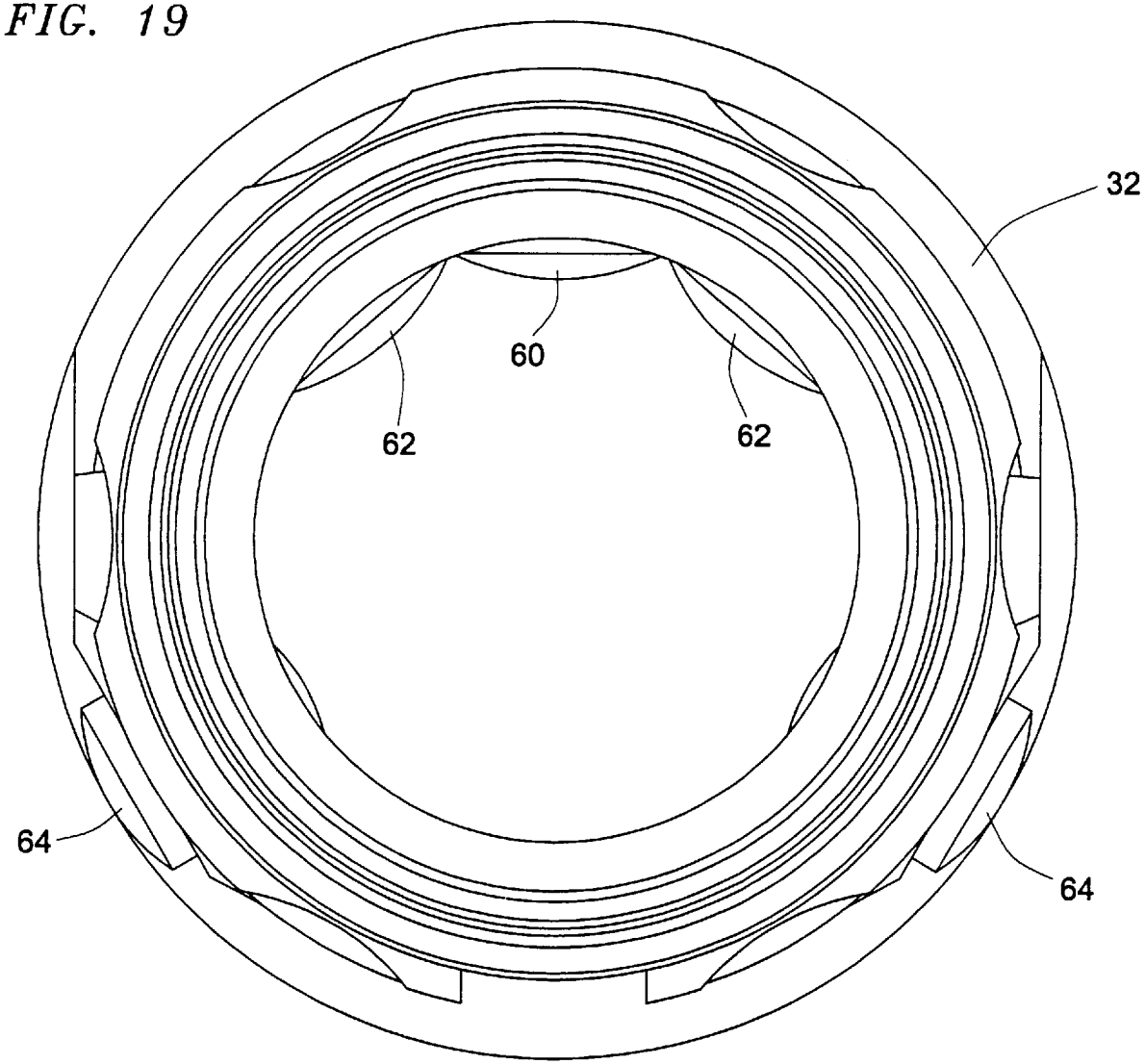
FIG. 19 is an end view of a rotary steerable tool according to the invention showing pistons set in the straight ahead drilling position.

The adjustable offset mechanism may for example be formed using plural pistons 60, 62 and 64 radially mounted in openings in housing 32. Pistons 60 and 62 are mounted in openings on thickened side 33 of the sleeve, while pistons 64 are mounted on the opposed side. Thickened side 33 has a larger radius than the opposed side, and pistons 64 are extendable outward to that radius. Pistons 62 are at 120 degrees on either side of piston 60 and extend outward at their maximum extension less than the extension of piston 60 when measured from the center of mandrel 50. Pistons 60 and 62 extend outward to a radius of a circle that is centered on a point offset from the center of mandrel 50, as shown in FIG. 18. As shown in FIGS. 4–6 and 12–14, hole grippers 65 are also embedded on either side of housing 32 at 90 degrees to piston 60. Hole grippers 65 are about 5 inches long, and are oriented, as with hole grippers 15, so that one edge lies furthest outward. Thus, hole grippers 65 assist in preventing housing 32 from rotating by engaging the hole wall with their outermost edge. Hole grippers 15 and 65 should be made of a suitably hard material, and may, for example, be power tong dies since these are readily available and may be easily removed for replacement. Pistons 60, 62 and 64 should also be made of a similar hard material.

Pistons 60, 62 and 64 are radially adjustable by actuation of mandrel 20 as follows. Dog clutch 66 is pinned by pins 68 to mandrel 20 to form a chamber 70 between housing 32 and upper mandrel 50. Dog clutch 66 has a dog face 67 that bears against dog face 69 on end cap 34 when upper mandrel 50 is raised in the hole. Wings 72 secured on pins 76 in the upper mandrel 50 are operable by fluid pressure in bore 30 if upper mandrel 50 through opening 74. Fluid pressure in bore 30 urges pistons 71 radially outward and causes wings 72 to swing outward on pins 76 into chamber 70. Upon reduction of fluid pressure in bore 30, wave springs 73 surrounding pistons 71 draw pistons 71 back into upper mandrel 50. A spring (not shown) is also placed around wings 72 seated in groove 77. Groove 77 is also formed in the outer surface of wings 72 and extends around upper mandrel 50. The spring retracts wings 72 when the pressure in bore 30 is reduced and wings 72 are not held by frictional engagement with collar 84.

Chamber 70 is bounded on its housing side by a sleeve 78, which acts as a retainer for a piston actuation mechanism held between shoulder 80 on end cap 34 and shoulder 82 on housing 32. The piston actuation mechanism includes thrust bearing 86 held between collars 84 and 88, cam sleeve 90 and spring 92, all mounted in that order on mandrel 32. Cam sleeve 90 is mounted over a brass bearing sleeve 91 that provides a bearing surface for cam sleeve 90. Spring 92 provides a sufficient force, for example 1200 lbs, to force cam sleeve 90 uphole to its uphole limit determined by the length of sleeve 78, yet not so great that downhole pressure on upper mandrel 50 cannot overcome spring 92. Spring 92 may be held in place by screws in holes 93 after spring 92 is compressed into position during manufacture, and then the screws can be removed and holes 93 sealed, after the remaining parts are in place.

Cam sleeve 90 is provided with an annular ramped depression in its central portion 94 and thickens uphole to cam surface 96 and downhole to cam surface 98, with greater thickening uphole. Piston 60 is offset uphole from pistons 64 by an amount L, for example 3-½ inches. Cam surface 96 is long enough and spaced from the center of depression 94 sufficiently, that when cam sleeve 90 moves a distance L downward to the position shown in FIG. 10, piston 60 rides on cam surface 96, while pistons 64 ride in the center of depression 94. Cam surface 98 is long enough and spaced from the center of depression 94 sufficiently, that when cam sleeve 90 is urged uphole by spring 92 to the position shown in FIG. 2C or 8C, pistons 64 ride on cam surface 98, while piston 60 rides in the center of depression 94. Thus, when cam sleeve 90 is forced downhole in relation to housing 32, pistons 60 ride on uphole cam surface 96, and are pressed outward into the well bore beyond the outer diameter of housing 32, while pistons 64 may retract into annular depression 94. When cam sleeve 90 is in the uphole position, pistons 60 are in annular depression 94, while pistons 64 ride on downhole cam surface 98. Pistons 62 will also ride on cam sleeve 90, but are slightly offset downhole from piston 60 and so do not extend as far outward. Since cam surface 98 has a smaller diameter than cam surface 96, the tool may move more readily in the hole when pistons 64 are extended for the straight ahead drilling position, and piston 64 and housing 32 act as a stabilizer. The stabilizer position or straight ahead drilling position of the pistons is shown in the end view FIG. 19 and the cross sections of FIGS. 5 and 6. The offset drilling position of the pistons is shown in the end view of FIG. 18 and the cross sections of FIGS. 12–14.

An orientation system is also provided on rotary steerable drilling tool 10. A sensor 102, for example a magnetic switch, is set in an opening in upper mandrel 50. A trigger 104, for example a magnet, is set in end cap 34 at a location where trigger 104 will trip sensor 102 when mandrel 20 rotates in an on-bottom drilling position (either offset or straight). Snap ring 105 should be non-magnetic. A further sensor 106 is set in upper mandrel 50 at a distance below sensor 102 about equal to the amount upper mandrel 50 is pulled back as shown in FIGS. 2A–2D, which will be slightly greater than the distance L, for example 4 inches when L is 3½ inches. Trigger 104 will therefore trip sensor 106 when mandrel 20 is pulled back and jaw clutch faces 67, 69 are engaged. This position allows the tool to be oriented with the MWD tool face. Sensors 104 and 106 communicate through a communication link, e.g. a conductor, in channel 105 with a MWD package in MWD tool 14. Sensors 102 and 106 are thus sensitive to the rotary orientation of housing 32 in relation to mandrel 20, and when trigger 104 trips one of sensors 102, 106, sends a signal to the MWD tool 14 that is indicative of the rotary orientation of housing 32 on mandrel 20.

For drilling in the straight ahead position shown in FIGS. 8A–8D and 9, mandrel 50 is set down on lower mandrel 52 so that shoulders 59 and 61 abut. Wings 72 are held in mandrel 50, and spring 92 urges cam sleeve 90 to the position shown in FIG. 8B, so that pistons 64 are forced outward by cam surface 98, and piston 60 lies in annular depression 94. In this position, pistons 64 and thickened portion of housing 32 form a circular stabilizer and mandrel 20 rotates within housing 32 centrally located in the hole.

For drilling in the offset position, rotary steerable drilling tool 10 is altered in position as shown in FIGS. 10–14. Upper mandrel 50 is lifted off lower mandrel 52 until dog face 67 engages dog face 69, and rotated at least 360 degrees to ensure engagement of faces 67 and 69. The orientation of housing 32 in the hole can then be determined by MWD tool 14 if the engaging position of dog faces 67, 69 is programmed in the MWD package. Housing 32 may then be rotated from surface using mandrel 20 into the desired direction of drilling in the offset drilling position. The drilling direction will conveniently coincide with the direction that piston 60 points. With dog faces 67, 69 engaged, fluid pressure is applied from surface to bore 30 of mandrel 20 to force wings 72 into a radially extended position. Mandrel 20, or more specifically upper mandrel 50, since lower mandrel 52 does not move in this operation, is then moved downward. Upon downward motion of mandrel 20, wings 72 drive cam sleeve 90 downward and lift piston 60 onto cam surface 96, thus extending piston 60 outward, while piston 64 moves into annular depression 94. The action of piston 60 bearing against the wellbore places rotary steerable tool 10 in an offset drilling position using rotary stabilizer 17 as a rotating fulcrum. The ratio of the offset caused by pistons 60, 62 to the offset at drill bit 16 is equal to the ratio of the distance of pistons 60, 62 from rotary stabilizer 17 to the distance of drill bit 16 from rotary stabilizer 17.

During straight ahead drilling, the location of housing 32 may also be determined by rotating mandrel 20 in housing 32 and taking readings from sensors 106. The timing of the readings from sensor 106 may be used by the MWD package to indicate the location of housing 32.

Immaterial modifications may be made to the invention described here without departing from the essence of the invention.

The invention in which an exclusive right is claimed is defined by the following:

1. A rotary steerable drilling tool, comprising:

(a) a mandrel;

(b) a housing mounted on the mandrel for rotation in relation to the mandrel;

(c) an adjustable offset mechanism on the housing, the adjustable offset mechanism being surface adjustable to move the rotary steerable drilling tool to and from a straight ahead drilling position and an offset drilling position, wherein the adjustable offset mechanism comprises plural pistons radially mounted in the housing, the plural pistons being radially adjustable by actuation of the mandrel, wherein the plural pistons comprise first and second pistons located on opposed sides of the housing, the first piston being extended and the second piston being retracted in the straight ahead drilling position, and the first piston being retracted and the second piston being extended in the offset drilling position, and wherein the pistons are actuated by a cam sleeve mounted on the mandrel;

(d) wings mounted on the mandrel and operable by fluid pressure within the mandrel into a radially extended position; and (e) the wings cooperating with the cam sleeve to drive the second piston outward and retract the first piston when the wings are in the extended position.

2. The rotary steerable drilling tool of claim 1 in which the mandrel comprises an upper mandrel splined with a lower mandrel, the wings are mounted on the upper mandrel, and movement of the upper mandrel with the wings extending radially outward operates the cam sleeve.

3. A drill string, comprising:

(a) a mandrel;

(b) a housing mounted on the mandrel for rotation in relation to the mandrel;

(c) an adjustable offset mechanism on the housing, the adjustable offset mechanism being surface adjustable to move the drill string to and from a straight ahead drilling position and an offset drilling position;

(d) first piston and second piston radially mounted in the housing, the first piston and second piston being radially adjustable by actuation of the mandrel; the first piston being extended and the second piston being retracted in the straight ahead drilling position, and the first piston being retracted and the second piston being extended in the offset drilling position;

(e) a cam sleeve mounted on the mandrel for actuating the first piston and second piston;

(f) wings mounted on the mandrel and operable by fluid pressure within the mandrel into a radially extended position;

(g) the wings cooperating with the cam sleeve to drive the second piston outward and retract the first piston when the wings are in the extended position;

(h) a drill bit terminating the drill string; and (i) a stabilizer on the drill string between the drill bit and mandrel.

4. A drill string, comprising:

(a) an upper mandrel;

(b) a lower mandrel slidably connected to the upper mandrel by splines;

(c) a housing mounted on the upper mandrel for rotation in relation to the upper mandrel;

(d) an adjustable offset mechanism on the housing, the adjustable offset mechanism being surface adjustable to move the drill string to and from a straight ahead drilling position and an offset drilling position;

(e) a drill bit terminating the drill string; and (f) a stabilizer on the drill string between the drill bit and lower mandrel.

5. The drill string of claim 4 in which the adjustable offset mechanism comprises plural pistons radially mounted in the housing, the plural pistons being radially adjustable by actuation of the upper mandrel.

6. The drill string of claim 5 in which the plural pistons comprise first and second pistons located on opposed sides of the housing, the first piston being extended and the second piston being retracted in the straight ahead drilling position, and the first piston being retracted and the second piston being extended in the offset drilling position.

7. The drill string of claim 6 in which the pistons are actuated by a cam sleeve mounted on the upper mandrel.

8. The drill string of claim 7, further comprising:

(a) wings mounted on the upper mandrel and operable by fluid pressure within the upper mandrel into a radially extended position; and (b) the wings cooperating with the cam sleeve to drive the second piston outward and retract the first piston when the wings are in the extended position.

9. The drill string of claim 8 in which the wings are mounted on the upper mandrel, and movement of the upper mandrel with the wings extending radially outward operates the cam sleeve.

10. The drill string of claim 4, further comprising a MWD tool on the drill string.

11. The drill string of claim 10, further comprising a first sensor on the upper mandrel that is sensitive to the rotary orientation of the housing, the first sensor being operably connected with the MWD tool to provide a signal indicative of the rotary orientation of the housing on the upper mandrel.

12. The drill string of claim 11 in which the first sensor comprises a switch on the upper mandrel that is sensitive to a trigger on the housing.

13. The drill string of claim 12 in which the trigger is a magnet.

14. The drill string tool of claim 11, further comprising:

(a) a second sensor on the upper mandrel, the second sensor being longitudinally offset from the first sensor;

(b) the first sensor being sensitive to the rotary orientation of the housing in relation to the upper mandrel when the drill string is in an on-bottom drilling position; and (c) the second sensor being sensitive to the rotary orientation of the housing in relation to the upper mandrel when the drill string is in a pulled back position.

* * * * *